US008096557B2

(12) United States Patent
Lin

(10) Patent No.: US 8,096,557 B2
(45) Date of Patent: Jan. 17, 2012

(54) BALL GAME APPARATUS AND METHOD THEREOF

(76) Inventor: Pei Lin Lin, Guangdong (CN)

( * ) Notice: Subject to any disclaimer, the term of this patent is extended or adjusted under 35 U.S.C. 154(b) by 75 days.

(21) Appl. No.: 12/449,998

(22) PCT Filed: Dec. 2, 2008

(86) PCT No.: PCT/CN2008/001961

§ 371 (c)(1),
(2), (4) Date: Sep. 3, 2009

(87) PCT Pub. No.: WO2009/094823

PCT Pub. Date: Aug. 6, 2009

(65) Prior Publication Data

US 2010/0090407 A1 Apr. 15, 2010

(30) Foreign Application Priority Data

Jan. 22, 2008 (CN) ..... 2008 1 0065945

(51) Int. Cl.
*F41J 5/00* (2006.01)

(52) U.S. Cl. ..... 273/371

(58) Field of Classification Search ..... 273/371–377, 273/398–402, 476–478, 190–197; 473/476–478, 473/190–197

See application file for complete search history.

(56) References Cited

U.S. PATENT DOCUMENTS

| | | | | |
|---|---|---|---|---|
| 4,927,160 | A * | 5/1990 | Nichol et al. | 273/371 |
| 5,704,612 | A * | 1/1998 | Kelly et al. | 273/402 |
| 6,254,502 | B1 * | 7/2001 | Becker | 473/594 |
| 6,569,028 | B1 * | 5/2003 | Nichols et al. | 473/192 |
| 7,523,942 | B2 * | 4/2009 | Chung | 273/317.1 |
| 7,857,316 | B2 * | 12/2010 | Shoemaker, Jr. | 273/317 |
| 2003/0030218 | A1 * | 2/2003 | Zucchi et al. | 273/371 |

* cited by examiner

*Primary Examiner* — Mark Graham

(74) *Attorney, Agent, or Firm* — Raymond Y. Chan; David and Raymond Patent Firm

(57) ABSTRACT

A ball game apparatus includes a ball target, one or more balls, and a rear unit. The ball target includes an upper target, a bottom net, and a target stand. The upper target is mounted at an upper portion of the target stand. The bottom net is mounted between the target stand and the upper target at a position that the bottom net is below the upper target. The upper target has a plurality of ball scoring holes and an electronic scoring board, wherein an electronic scoring circuit is provided within the upper target. Each ball is made by elastic and flexible material and is filled with iron sands. The rear net unit, which is positioned behind the ball target, includes a net and a rear net stand, wherein the net is supported by the rear net stand to extend to an opened configuration of the rear net unit.

6 Claims, 2 Drawing Sheets

BALL GAME APPARATUS AND METHOD THEREOF

BACKGROUND OF THE PRESENT INVENTION

1. Field of Invention

The present invention relates to a ball game apparatus, which can be considered as a form of sports contest for competition or exercise. Meanwhile, the present invention has relatively high entertaining value, is competitive, and requires highly skills for playing the ball game.

2. Description of Related Arts

The existing competitive sports games, such as golf, darts, and bowling, are popular. However, the existing competitive sport games are limited to be universalized. For example, golf and bowling need high requirement of skills, places for playing golf and bowling to meet the basic demands and space, and relatively high cost. The dart game lacks of competitiveness and entertainment.

SUMMARY OF THE PRESENT INVENTION

An object of the present invention is to provide a ball game apparatus for a novel ball sport game, which is a sport to pitch the ball into a predetermined hole. The novel ball sport game has the characteristics of shooting of the darts, and competitiveness of bowling and golf at the same time.

According to accomplish the above object, the present invention provides a ball game apparatus, which comprises:

a ball target, which comprises an upper target, a bottom net, and a target stand, wherein the upper target is mounted at an upper portion of the target stand, and the bottom net is mounted between the target stand and the upper target at a position that the bottom net is below the upper target, wherein the upper target has a plurality of ball scoring holes and an electronic scoring board, wherein an electronic scoring circuit is provided within the upper target;

one or more balls, which are made by an elastic and flexible material, wherein each of the balls is filled with iron sands, so that the weight of each of the balls has a range from 250 gram to 500 gram; and a rear net unit, which comprises a net and a rear net stand, wherein the net is supported by the rear net stand, so as to extend to an opened configuration of the rear net.

The upper target comprises an outer frame, a surface panel, a front panel, a rubber panel, and a rear panel, wherein the surface panel and the front panel has a plurality of said ball scoring holes therethrough, wherein each of the ball scoring holes comprises a rubber ring, an affixing ring, and a back hole cover, and affixed at the rubber panel.

The electronic scoring board is provided at the surface panel, wherein the electronic scoring circuit is provided within the electronic scoring board, wherein the ball scoring holes are located at a position in relation to the electronic scoring circuit.

One or more controlling buttons are provided to selectively control the operation of the electronic scoring circuit in an on-and-off manner.

Four light housings are provided at four corners of the outer frame of the upper target of the ball target respectively, wherein one or more LEDs are provided within each of the light housings.

The bottom net is extended from a rear side of the ball target to connect to the rear panel.

A power source, such as a battery or an external power supply circuit, is provided at the rear panel.

The present invention is a novel ball type sport game, which is simple in structure, unique in design, low in manufacturing cost, and has the characteristics of shooting of the darts, and the elegant posture of bowling and golf at the same time, so that the novel ball sport can be considered as a form of sports contest for competition or exercise. Meanwhile, the present invention has relatively high entertaining value, is competitive, and requires highly skills for playing the ball game.

These and other objectives, features, and advantages of the present invention will become apparent from the following detailed description, the accompanying drawings, and the appended claims.

DETAILED DESCRIPTION OF THE PREFERRED EMBODIMENT

In order to show and describe for the purpose and skills of the present invention, below will combine preferred embodiments to further illustrate the functional and structural principles of the present invention.

Figure 1:
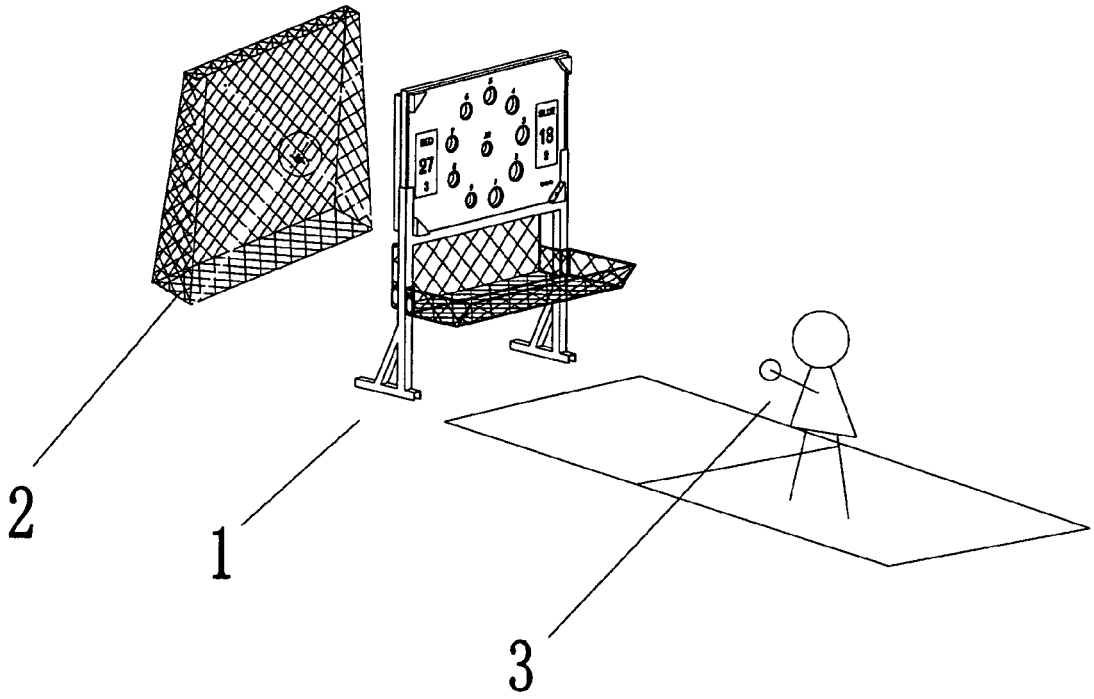
FIG. 1 is a perspective view of a ball game apparatus according to a preferred embodiment of the present invention.

Referring to FIG. 1 of the drawings, a ball game apparatus of the present invention is illustrated, wherein the ball game apparatus comprises a ball target 1, a rear net unit 2, and one or more balls 3. The ball 3 is made by one or more materials, which have the characteristics of elasticity and flexibility. In the present invention, the ball 3 is preferably made of leather. Accordingly, the skin of the ball 3 is made of leather, wherein the filler, preferably iron sands or other filler, is filled in the skin of the ball 3. The weight of the ball 3 is preferably between 250 gram and 500 gram. According to the preferred embodiment, the ball 3 mainly has two levels, 250 gram and 500 gram. The weight of the ball 3 is selectively adjusted according to different conditions.

Figure 2:
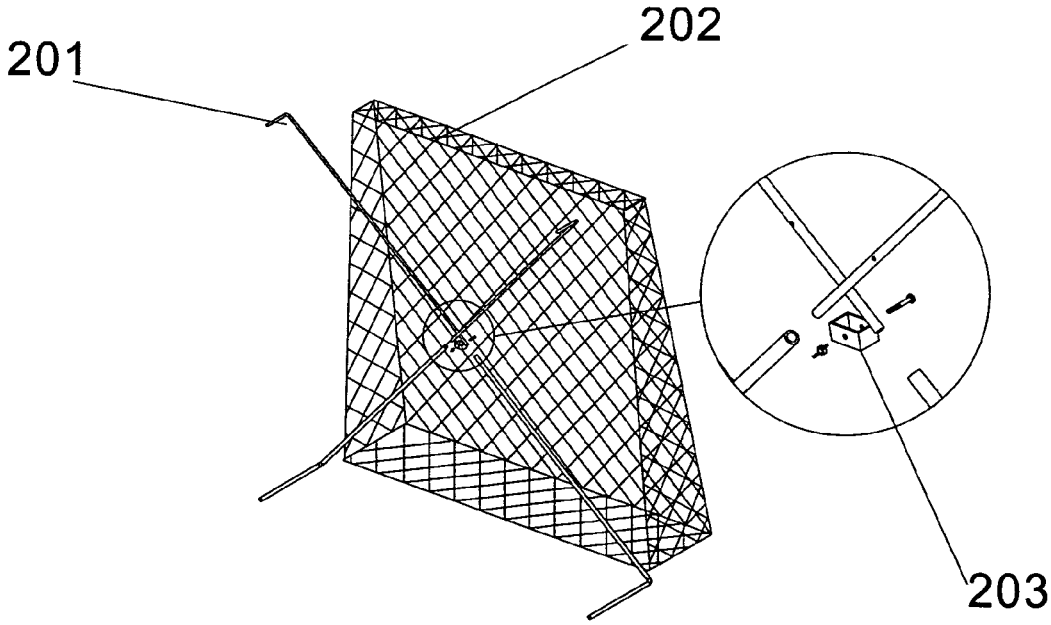
FIG. 2 is a perspective view of a rear net of the ball game apparatus according to the preferred embodiment of the present invention.

As shown in FIG. 2, the rear net unit 2 further comprises a net 202 and a rear net stand 201, wherein the net 202 is supported by the rear net stand 201, so as to extend to an opened configuration of the rear net unit 2. The rear net stand 201 further comprises four elongated elements, wherein the outer end of each of the elongated elements is bended to form a hook configuration. The elongated elements of the rear net stand 201 are radially extended to support and retain the rear net unit 2 in position via the hooks. The elongated elements of the rear net stand 201 are radially and detachably bifurcated from each other to connect with each other at a center point via a connecting member 203. It is worth to mention that the structure of the rear net stand 201 is able to effectively save the storage space and conveniently assemble the rear net stand 201.

Figure 3:
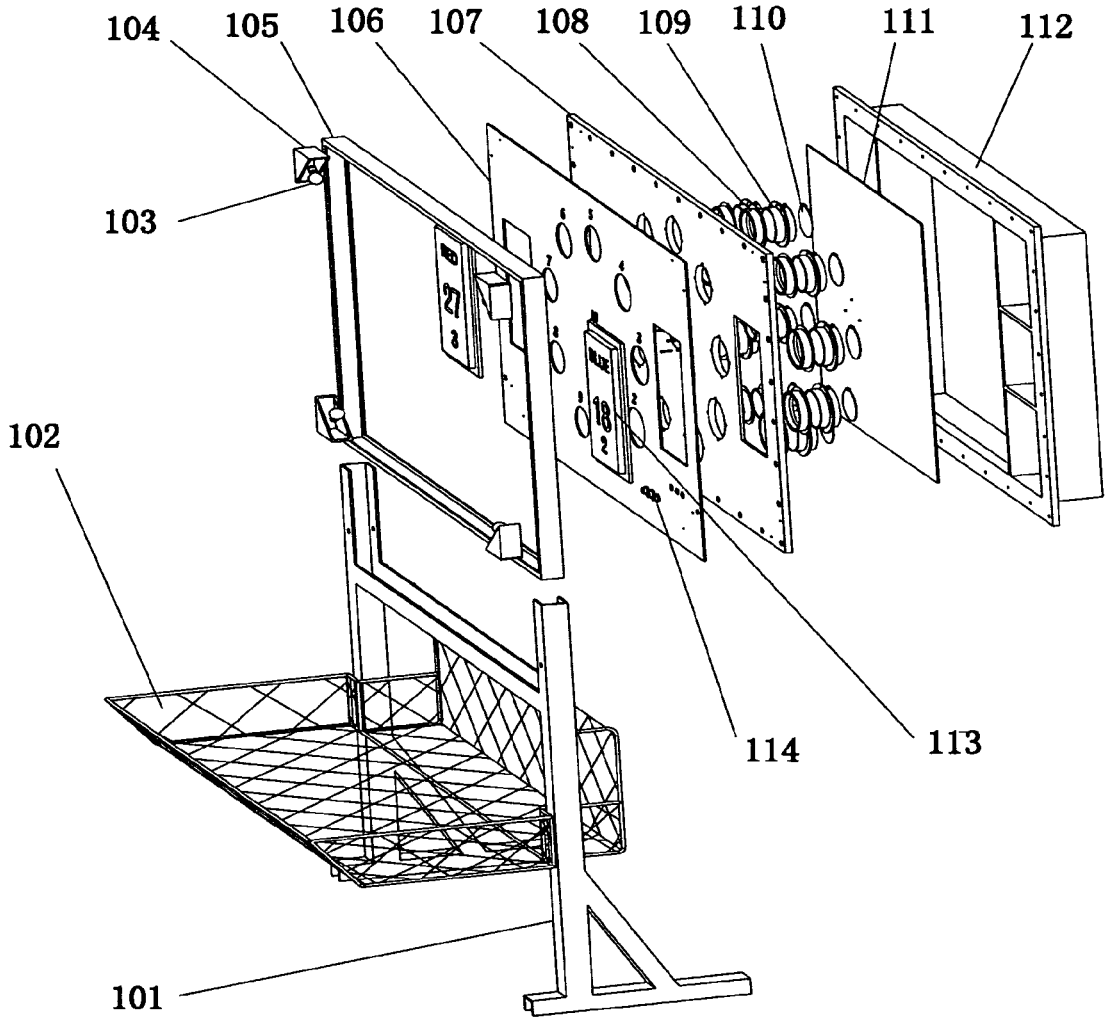
FIG. 3 is an exploded perspective view of a ball target of the ball game apparatus according to the preferred embodiment of the present invention.

As now shown in FIG. 3, the ball target 1 comprises an upper target, a bottom net 102, and a target sand 101. The upper target is mounted at an upper portion of the target stand 101, and the bottom net 102 is mounted between the target stand 101 and the upper target at a position that the bottom net 102 is below the upper target. Accordingly the upper target has a plurality of ball scoring holes and an electronic scoring board, wherein an electronic scoring circuit is provided within the upper target.

The upper target comprises an outer frame 105, a surface panel 106, a front panel 107, a rubber panel 111, and a rear panel 112, wherein the surface panel 106 and the front panel 107 have a plurality of corresponding holes aligned to form the ball scoring holes therethrough. Each of the ball scoring holes is formed by a rubber ring 108, an affixing ring 109, and a back hole cover 110. The ball scoring holes are affixed at the rubber panel 111 in position. The upper target is mounted at an upper portion of the stand 101, wherein each of the ball scoring holes provided at the surface panel 106 and the front panel 107 has a corresponding score. Preferably the ball scoring hole which is closer to a center portion of the surface panel 106 has a higher score value, while a diameter of the ball scoring hole toward the center portion of the surface panel 106 is smaller than the diameter of the ball scoring hole away from the center portion of the surface panel 106. In other words, the ball scoring hole with a smaller diameter have the higher score value. The ball scoring hole is formed by the rubber ring 108, the affixing ring 109, and the back hole cover 110. The rubber ring 108 is protruded out of the surface panel 106, and a rear end portion 4 of rubber ring 108 of the ball scoring hole is affixed by the affixing ring 109, wherein the back hole cover 110 is affixed to a rear side of the affixing ring 109, in such a manner that when the ball 3 is pitched or threw into the ball scoring hole to hit the back hole cover 110, a pulse signal is generated and transmitted to the electronic scoring circuit. The score will be appeared on the electronic scoring board for displaying the scores, and a detecting LED light 113 will generate a corresponding light.

In order to play the ball game apparatus at night time or in a dim environment, one or more LEDs 103 are preferably provided at four corners of the outer frame 105. wherein a light housing 104 is provided at the corners of the outer frame 105 to enclose and protect the LEDs 103.

Additionally, the ball game is a type of pitching ball sport. Therefore, in order to avoid any damages from the ball directly impacting on the ball target, the light housings 104 and the outer frame 105 are preferably made of durable material such as aluminum alloy material or the likes. The surface panel 106 is preferably made by PU leather, and the front panel 107 is preferably made by wooden material.

The electronic scoring board and one or more controlling buttons 114 are affixedly mounted on the surface panel 106 and the front panel 107. The electronic scoring board is electrically linked to the electronic scoring circuit in the rear panel 112 and to one or more batteries or external power of the power source via a plurality of wires. The rear panel 112 is located at a position behind the rubber panel 111, so as to maximize the protection of the electronic scoring board and the batteries of the power source.

The bottom net 102 is formed by one or more steel tubes and a plurality of net strands, wherein the bottom net 102 is rearwardly extended from a rear side of the bottom net 102 to connect with the rear panel 112, so that when the ball 3 is pitched into one of the ball scoring holes, the ball 3 is rolling along the rubber panel 111 to the bottom net 102. Therefore, the balls 3 have no need to be picked up. Even if the balls 3 are not pitched into the ball scoring holes, the rear net unit 2 is able to further block and collect the balls 3, in such a manner that the user of the ball game apparatus is able to conveniently collect the balls 3 after he or she pitched the balls 3.

The above are the descriptions of the structure of the ball game apparatus. Below further describe the rules and how to use the ball game apparatus.

As shown in FIG. 1 of the drawings, the present invention is a single-player ball game. The first step is to choose a suitable site for playing the ball game apparatus, wherein the rear net unit 2 and ball target are lined up in the same direction. The ball target is located at a position in front of the rear net unit 2, and then the athlete or player is standing in front of the ball target at a predetermined distance. (Usually select 5 meters or 8 meters as the predetermined distance between the player and the ball target, and the specific circumstances depend on the athletes or players).

Accordingly, the vertical distance from the center point of the ball target to the ground is about 1.8 meters. The ball target is vertical to the ground surface. Each of the games has to use the same size of the balls 3, and the distance between each of the players and the ball target of each of the game should be the same.

The ball game apparatus of the present invention is good for people to do exercise or for playing games.

The followings will more specifically and exemplary describe the method of using the present invention. (Take a red team and blue team players for example. The balls used for both red and blue teams are the same type).

Before starting the game, the ball game apparatus is electrically linked to the external power source or inserting batteries in the apparatus, and then turn on the power of the ball game apparatus, so that the present ball game apparatus is at the working status. Meanwhile, the LED electronic scoring boards at both right and left hand side of the ball target are started, the LEDs 103 at the corners of the outer frame 105 of the ball target are lightened, and a sound is ringed, so that the game now can be started.

The ball target preferably has ten ball scoring holes, which are hole#1, hole#2, hole#3, hole#4, hole#5, hole#6, hole#7, hole#8, hole#9, and hole#10 respectively.

The diameters of the ball scoring holes from hole#1 to hole#10 are 200, 190, 180, 170, 160, 150, 140, 130, 120, and 110 mm respectively.

And the scores of the ball scoring holes from hole#1 to hole#10 are represented for 1 point, 2 points, 3 points, 4 points, 5 points, 6 points, 7 points, 8 points, 9 points, and 10 points respectively.

The players have to shoot or throw the balls into the ball scoring holes to get the corresponding points with respect to the ball scoring holes. A LED detecting light of the ball scoring hole blinks when the ball 3 hits the corresponding back hole cover 110, and the electronic scoring board will start to count.

When the LED represented to one of the teams is on, the corresponding team will start to throw the ball. For example, if the RED light is on, the red team will start to throw the balls; if the BLUE light is on, the blue team will start to throw the balls.

During each game of the ball game apparatus, ten balls 3 are thrown for each round within a predetermined time period, such as five minutes. One ball can be thrown at a time.

The players have to throw the balls by their own hands without any other equipment to assist them throwing the ball. They may able to shoot or throw the ball by run-up skill. However, the players have to stand beyond a throwing line which is used for indicating the predetermined distance between the ball target and the player.

After the red team is done shooting or throwing the designated ten balls, the balls will be picked up by designated people and handed to the next throwing team. Then, the blue team will start throwing the ball.

The players are prohibited to stay both feet off the ground at the same time, such as jumping. If both feet are staying off the ground at the same time, it is a foul and the point will not be counted.

The players can not step on or over the throwing line by both feet in every runs of the game. If the player steps on the throwing line, the point of this shot does not counted. In other words, the player must not be stay beyond the throwing line to throw the ball. The score is recorded only with the valid trail of the ball throwing.

Throwing action: the designated two throwing actions are "overhand delivery" and "underhand delivery". Other positions for throwing the ball are not allowed and the score will not be counted.

Once the ball held by the player is out of the player's hand after the referee announced the beginning of the game in any way, the player can not re-cast or re-throw the ball since the ball had been thrown.

The rules of the ball game of present invention are as followings:

1. Throwing the balls into the holes in order (start throwing from hole#1, two or more balls are thrown into the holes orderly). If the player is casting the ball in order of the number of the holes, hole#1, hole#2, hole#3, hole#4, hole#5, hole#6, hole#7, hole#8, hole#9, and hole#10, the scoring for each of the holes will be 1 point, 4 points, 6 points, 8 points, 10 points, 12 points, 14 points, 16 points, 18 points, and 20 points, which are double of the number of the each number of holes.

First example: If the player is throwing the balls in the order of hole#1 to hole#10, and all the balls are thrown into the ball scoring holes, the scores will be the sum of the points of 1, 4, 6, 8, 10, 12, 14, 16, 18, 20, which totally is scored 109 points.

If the player throws the balls in the order of hole#1, hole#2, hole#3, hole#4, hole#5, hole#6, hole#7, hole#8, hole#9, and hole#10, and missed one shot of the ball, the score before the missed shot will be doubled, and the score after the missed shot will remain at the original point of that hole.

Second example: The player is throwing the balls in order and only missed out the shot of hole#5.

Therefore, the scores from hole#1 to hole#4 are the sum of points of 1, 4, 6, 8, i.e. the total point is 19. Since hole#5 is missed, the score will not be counted. The point for hole#6, hole#7, hole#8, hole#9, and hole#10 are scored as the original point, so that the total score from hole #6 to hole#10 is the sum of points of 6, 7, 8, 9, and 10, which is 40. Thus, the overall score of this run of the game is 59 points.

It is appreciated that the throwing in sequence has to start from hole#1 and continuously throwing into two sequenced holes, so that if the player missed the hole#1, then the rest of the shots can not be counted as the way of throwing in order.

For another example, the player missed out the shot of hole#1, but threw the rest of balls are thrown into the hole#2, hole#3, hole#4, hole#5, hole#6, hole#7, hole#8, hole#9, and hole#10 in order.

Therefore, all of the points can not be counted as throwing in order. The scoring method will base on the non-orderly throwing manner. Therefore, the overall score for this run is the sum of points 2, 3, 4, 5, 6, 7, 8, 9, and 10, which is 54 points.

The highest score for throwing in order is 109.

The lowest score for throwing in order is 5.

2. Throwing non order (throwing each of the balls non orderly):

If the player does not throw the ball in order, then the point of each hole is the same as the original point of each ball scoring holes.

Therefore, the point of scoring in a non orderly throwing manner is the same of the number of the ball scoring hole.

For example: if the player threw into the hole#2, hole#3, hole#4 and missed out the rest seven holes, the overall score is 2+3+4, which is 9 points.

The highest score of throwing non orderly is the sum of 2, 3, 4, 5, 6, 7, 8, 9, 10, 1, which is 55 point.

The lowest score of throwing non orderly is 0 (miss all 10 balls).

3. Throwing into the same ball scoring hole twice or more:

If the player threw two or more balls into the same ball scoring hole, the score can be accumulated.

For example: if the player threw eight balls into hole#9, the score is 8*9, which is 72 points.

The highest score of throwing into the same ball scoring hole is 100 points (all ten balls are thrown into hole#10).

The lowest score of throwing into the same ball scoring hole is 2 point (2 balls are thrown into hole#1 and the rest of 8 balls are missed).

The regulation time period is set as 5 minutes for each of the teams, wherein the time will be displayed on the electronic scoring board in a counting down manner. Therefore, the time will be started 300 seconds. The balls are thrown within five minutes, and the corresponding point will be counted. The team who get higher score is the winner. If the scores are the same, it is tie. An overtime game can be arranged if it is needed to determine the winner.

This is a culture, elegant, healthful, and fashion sport and exercise, leisure, communicate, networking way, and particularly suitable for those high tense people in the fast pace of modern city to provide a healthy life style option. The sport is not limited by age and gender, easily to learn, no physical body contact, and can be played indoor or outdoor, so that it is a novel sport for everybody, such as men, women, senior, and child.

The present ball game apparatus is mainly developed for training the attention, coordination, and sophistication of human, and particularly for the psychological training. The sport is good for entertaining, competing, and practicing skills. Also, the present invention not only enhances the body strength of the player, decreases the fatigue, and enhances the coordination ability of the body, but also trains the mental and spiritual discipline.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A ball game apparatus, comprising:

a ball target 1, which comprises an upper target, a bottom net 102, and a target stand 101, wherein said upper target is mounted at an upper portion of said target stand 101, and said bottom net 102 is mounted between said target stand 101 and said upper target at a position that said bottom net 102 is below said upper target, wherein said upper target has a plurality of ball scoring holes and an electronic scoring board, wherein an electronic scoring circuit is provided within said upper target;

one or more balls 3, which are made by an elastic and flexible material, wherein each of said balls 3 is filled with iron sands, wherein the weight of each of said balls 3 is between from 250 gram and 500 gram; and a rear net unit 2 which is positioned behind said ball target, comprising a net 202 and a rear net stand 201, wherein said net 202 is supported by said rear net stand 201, so as to extend to an opened configuration of said rear net unit 2;

wherein said upper target comprises an outer frame 105, a surface panel 106, a front panel 107, a rubber panel 111, and a rear panel 112, wherein said surface panel 106 and said front panel 107 have a plurality of holes alignedly to form said ball scoring holes therethrough, wherein each of said ball scoring holes, which comprises a rubber ring 108, an affixing ring 109, and a back hole cover 110, is affixed at said rubber panel 111.

2. The ball game apparatus, as recited in claim 1, wherein said electronic scoring board is provided at said surface panel 106, wherein said electronic scoring circuit is provided within said electronic scoring board, wherein said ball scoring holes are located at a position in relation to said electronic scoring circuit.

3. The ball game apparatus, as recited in claim 2, further comprising one or more controlling buttons 114, wherein said controlling buttons 114 selectively control an operation of the electronic scoring circuit in an on-and-off manner.

4. The ball game apparatus, as recited in claim 1, wherein four light housings are provided at four corners of said outer frame 105 of said upper target of said ball target, wherein one or more LEDs are provided within each of said light housings.

5. The ball game apparatus, as recited in claim 1, wherein said bottom net 102 is extended from a rear side of said ball target to connect to said rear panel 112.

6. The ball game apparatus, as recited in claim 1, wherein a power source, which is a battery or an external power supply circuit, is provided at said rear panel 112.

* * * * *